US008250944B2

(12) United States Patent
Wu

(10) Patent No.: US 8,250,944 B2
(45) Date of Patent: Aug. 28, 2012

(54) ACCELERATING HANDLE ASSEMBLY FOR ELECTRIC VEHICLE

(76) Inventor: Tsung Min Wu, Tainan (TW)

( * ) Notice: Subject to any disclaimer, the term of this patent is extended or adjusted under 35 U.S.C. 154(b) by 222 days.

(21) Appl. No.: 12/833,217

(22) Filed: Jul. 9, 2010

(65) Prior Publication Data

US 2012/0006144 A1 Jan. 12, 2012

(51) Int. Cl.
*G05G 1/10* (2006.01)

(52) U.S. Cl. ..... 74/488; 324/207.25; 267/169

(58) Field of Classification Search ..... 74/488, 74/489; 267/169, 174, 178, 155; 324/207.2, 324/207.21, 207.25
See application file for complete search history.

(56) References Cited

U.S. PATENT DOCUMENTS 863,055 A * 8/1907 Diehl ..... 464/44
5,682,963 A * 11/1997 Tang ..... 188/24.22
6,353,314 B1 * 3/2002 Moerbe ..... 324/207.22
6,994,179 B2 * 2/2006 Huntsberger et al. ..... 180/65.22
7,231,904 B2 * 6/2007 Hino et al. ..... 123/399
2009/0201014 A1 * 8/2009 Cavallo ..... 324/207.25

FOREIGN PATENT DOCUMENTS

TW M342328 * 5/1997

* cited by examiner

*Primary Examiner* — Troy Chambers
*Assistant Examiner* — Terence Boes
(74) *Attorney, Agent, or Firm* — Rosenberg, Klein & Lee

(57) ABSTRACT

An accelerating handle assembly for an electric vehicle includes first and second rings fixed together with a gap formed therebetween. A tubular handle has an end received in the gap and abutting a stepped portion of the first ring. A magnet is mounted to the tubular handle. A Hall sensor is fixed to the first or second ring and includes a detecting face facing the magnet. An arcuate clamping member is fixed to an outer periphery of the tubular handle and includes two ends respectively having two attachment seats. A spring unit includes a follower rod having two ends respectively fixed to the attachment seats of the first clamping member. The spring unit further includes a compression spring having a first end abutting an end of the first clamping member. The compression spring further has a second end abutting a restraining block of the second ring.

4 Claims, 6 Drawing Sheets

ACCELERATING HANDLE ASSEMBLY FOR ELECTRIC VEHICLE

BACKGROUND OF THE INVENTION

The present invention relates to an accelerating handle assembly for an electric vehicle and, more particularly, to an accelerating handle assembly for an electric two-wheeled vehicle.

Due to limited oil resources, innovation on industries using substitutive energy is in progress, such as electric vehicles using electricity as the power. Manufacturers of two-wheeled electric vehicles such as electric scooters or electric motorcycles still produce handle-type accelerators so that drivers can accelerate the two-wheeled electric vehicles like they do on conventional gasoline-consuming two-wheeled vehicles.

Taiwan Utility Model No. M342328 discloses an accelerating handle assembly for an electric vehicle. The accelerating handle assembly includes a fixed seat having a compartment in which a partitioning plate is mounted. A groove is formed between the partitioning plate and the fixed seat. A positioning block is mounted in the compartment and receives a Hall sensor. A lid is fixed to the fixed seat. A rotational tubular handle has an annular portion in an end thereof. A permanent magnet is mounted in the annular portion. The annular portion is rotatably received in a combined structure of the fixed seat and the lid. A rotational path of the permanent magnet is aligned with the Hall sensor.

A torsion spring and an end cap are mounted to the annular portion. An end of the torsion spring is inserted into a hole. The other end of the torsion spring is attached to the end cap. The torsion spring provides elasticity for returning the rotational tube. However, the torsion spring includes a plurality of turns in an axial direction and, thus, occupies a considerable space. Improvement in minimizing the torsion spring is possible, for the torsion spring in an accelerating handle of an electric vehicle can provide smaller returning force because it does not have to return an accelerating valve in a gasoline-consuming two-wheeled vehicle.

Furthermore, a larger extent of shifting and vibration occur during rotational movement of the rotational tube, adversely affecting the detection precision in the circumferential direction. Although the permanent magnet and the Hall sensor are well known, improvement in the spatial relationship between the permanent magnet and the Hall sensor is still possible.

Thus, a need exists for an improved accelerating handle assembly that is compact and that obviates and/or mitigates the above disadvantages.

BRIEF SUMMARY OF THE INVENTION

The present invention solves this need and other problems in the field of compact accelerating handle assemblies for electric vehicles by providing, in a preferred form, an accelerating handle assembly including a first ring having an inner side with a stepped portion. A second ring is fixed to the second ring and includes a restraining block in a circumferential path defined by the second ring. A gap is formed between the first and second rings. A tubular handle has an end received in the gap between the first and second rings and abutting the stepped portion of the first ring. The other end of the tubular handle is located outside of the gap between the first and second rings. A magnet is mounted to the tubular handle. A Hall sensor is fixed to the first ring or the second ring. The Hall sensor includes a detecting face facing the magnet. An elastic device includes a first clamping member and a spring unit. The first clamping member is arcuate and fixed to an outer periphery of the tubular handle. The first clamping member includes two ends respectively having two attachment seats. The spring unit includes a follower rod having two ends respectively fixed to the two attachment seats of the first clamping member. The spring unit further includes a compression spring having a first end abutting one of the two ends of the first clamping member. The compression spring further has a second end abutting the restraining block of the second ring.

The compression spring can be linearly compressed. Since the tubular handle of the accelerating handle assembly for an electric vehicle requires smaller resilient returning force, the compression spring according to the preferred teachings of the present invention provides a compact design.

In the most preferred form, the first clamping member includes an axial groove in which the magnet is received. A second clamping member is mounted to an outer side of the first ring. The second clamping member is arcuate and includes two ends that are diametrically opposed. Each of the two ends of the second clamping member has a screw hole threadedly receiving a fastener. The fasteners are adapted to be operated to clamp the second clamping member on a handle body of the electric vehicle. The restraining block is formed on a bottom edge of a top section of an annular body of the second ring.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
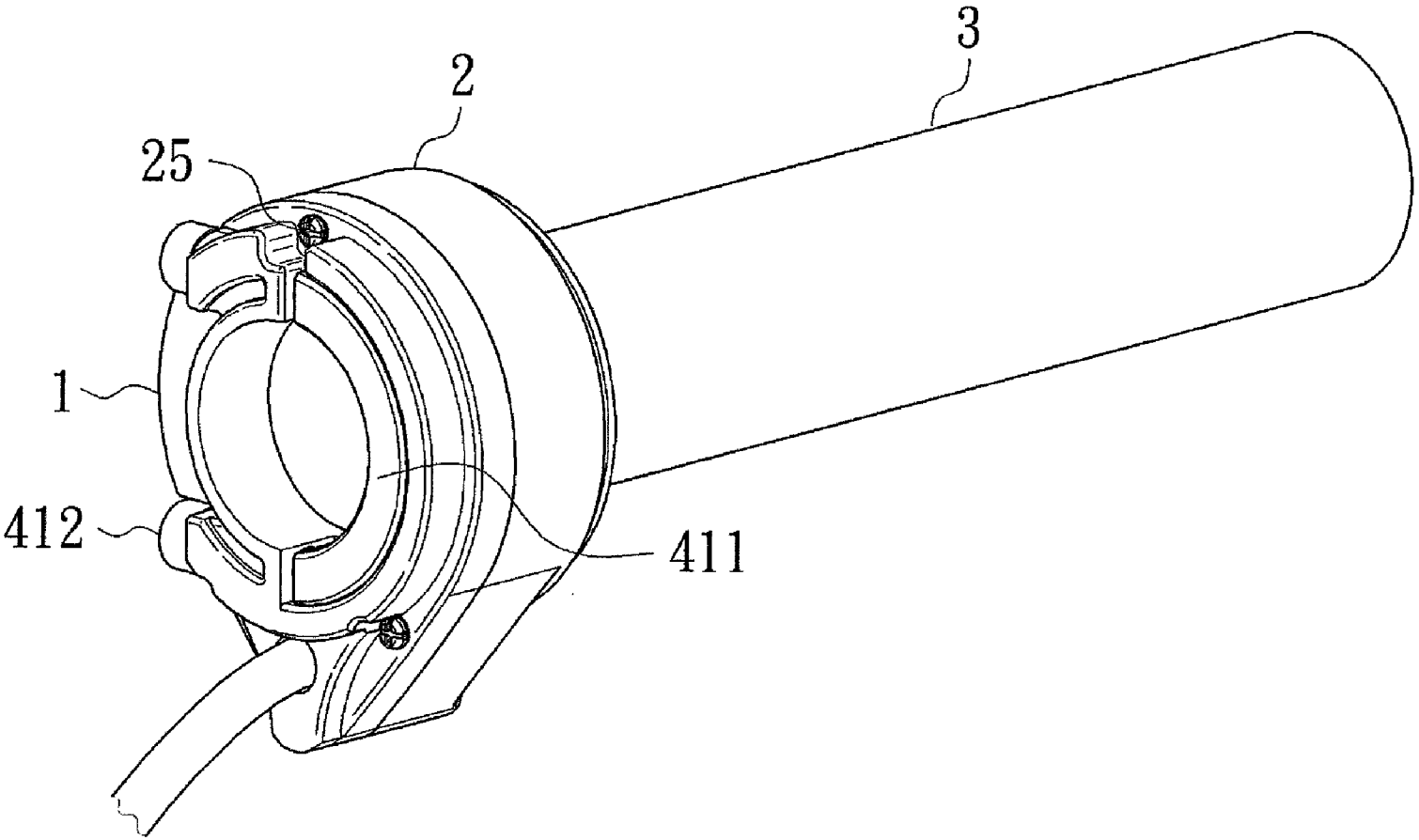
FIG. 1 shows a perspective view of an accelerating handle assembly for an electric vehicle according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

An accelerating handle assembly according to the preferred teachings of the present invention is shown in the drawings and generally includes a first ring 1 having a plurality of axially extending holes 11. The first ring 1 includes an inner side having a stepped portion 24. The accelerating handle assembly further includes a second ring 2 having a plurality of axially extending holes 20. A plurality of screws 25 is extended through the holes 11 and 20 to fix the first and second rings 1 and 2 together. The number of the holes 11 and 20 and the screws 25 is three in the preferred form shown. However, the holes 11 and 20 and the screws 25 are not limited to this number.

A gap 23 (FIG. 6) is defined between the first and second rings 1 and 2 after engagement. The second ring 2 includes a restraining block 21 on a top of a circumferential path defined by the second ring 2. Preferably, the restraining block 21 is formed on a bottom edge of a top section of an annular body of the second ring 2, providing a simplified structure.

Figure 6:
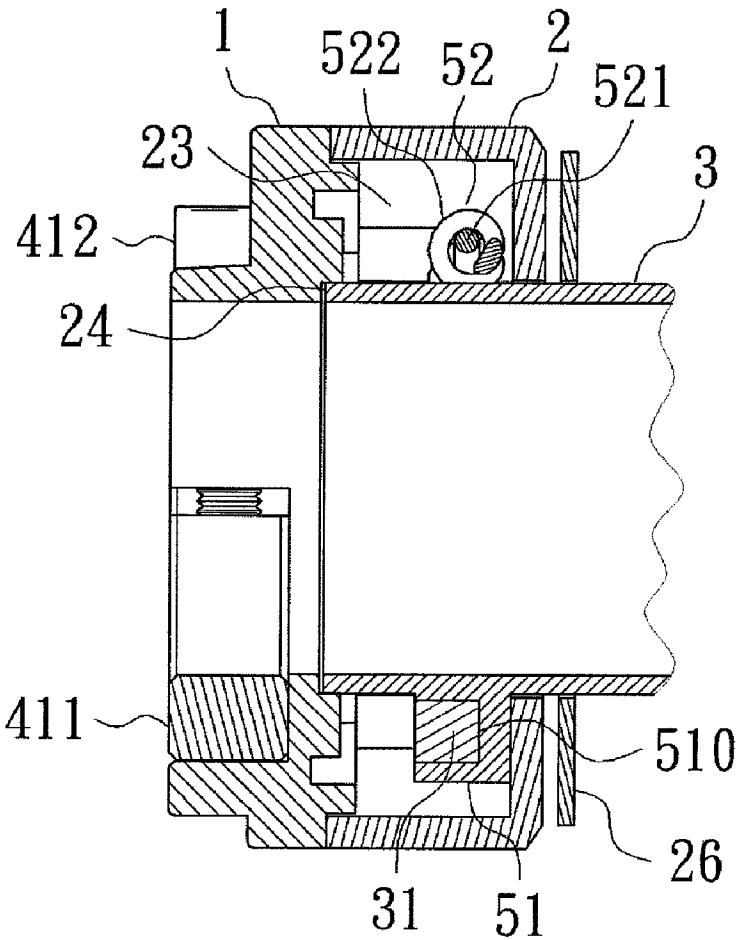
FIG. 6 shows a partial, cross sectional view of the accelerating handle assembly of FIG. 1.

The accelerating handle assembly further includes a tubular handle 3 to which a magnet 31 is mounted. With reference to FIG. 6, an end of the tubular handle 3 is received in the gap 23 between the first and second rings 1 and 2 and abuts the stepped portion 24 of the first ring 1. The other end of the tubular handle 3 is located outside of the gap 23 between the first and second rings 1 and 2. The tubular handle 3 is also extended through a washer 26 located on an outer side of the second ring 2. The washer 26 increases mounting stability and avoids interference between the tubular handle 3 and the second ring 2.

A Hall sensor 4 is fixed to the first ring 1 or the second ring 2. In the preferred form shown, the Hall sensor 4 is fixed by screws 41 extending through holes 40 of the Hall sensor 4 to a screw seat 22 of the second ring 2. The Hall sensor 4 has a detecting face facing the magnet 3.

The accelerating handle assembly further includes an elastic device 5 including a first clamping member 51 and a spring unit 52. The first clamping member 51 is arcuate and fixed to an outer periphery of the end of the tubular handle 3 in the most preferred form shown. The first clamping member 51 includes two ends respectively having two attachment seats 53A and 53B. The spring unit 52 includes a follower rod 521 having two ends respectively fixed to the attachment seats 53A and 53B of the first clamping member 51. The spring unit 52 further includes a compression spring 522 having a first end 522A abutting an end of the first clamping member 52. The compression spring 522 further has a second end 522B abutting the restraining block 21 of the second ring 2. The compression spring 522 can be linearly compressed. Since the tubular handle 3 of the accelerating handle assembly for an electric vehicle requires smaller resilient returning force, the compression spring 522 according to the preferred teachings of the present invention provides a compact design.

The magnet 31 is preferably received in an axial groove 510 of the first clamping member 51. Since two ends of the tubular handle 3 are fixed in an axial direction after assembly, mounting of the magnet 31 in the axial recess 510 permits a magnetic face of the magnet 31 to face the axial direction. At the same time, the Hall sensor 4 is fixed to the first ring 1 or the second ring 2 with the detecting face of the Hall sensor 4 directly facing the magnet 31. Thus, the stability in magnetic induction between the Hall sensor 4 and the magnet 31 can be increased, whether the electric vehicle is still or moving.

Figure 5:
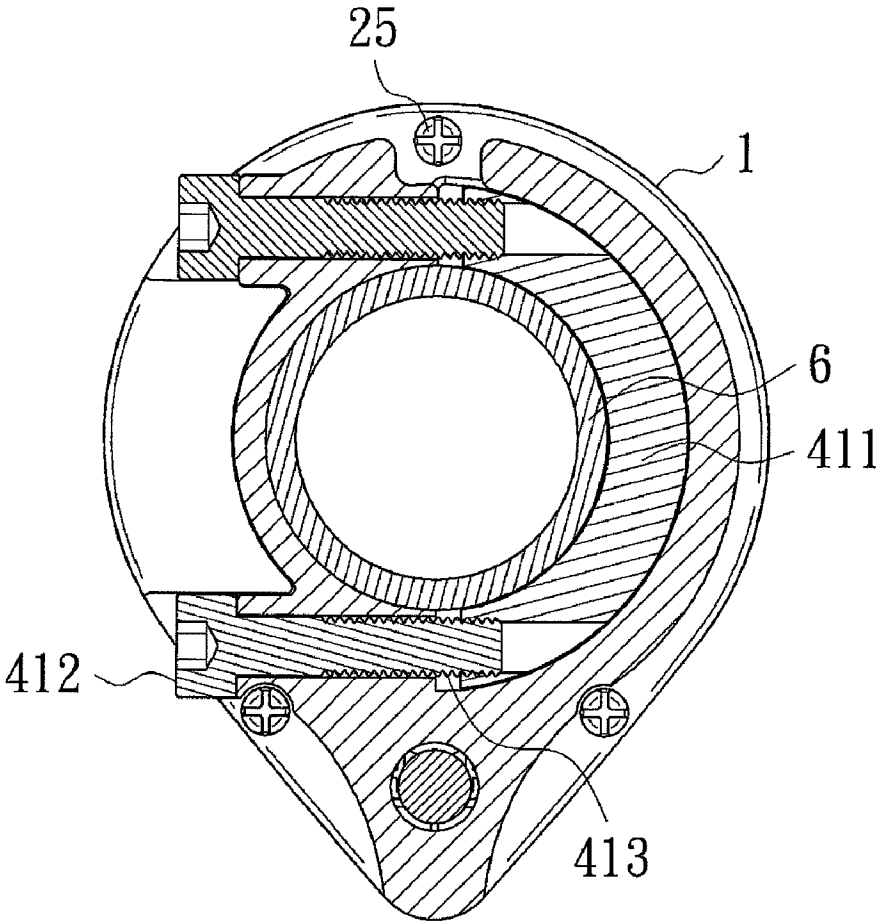
FIG. 5 shows another cross sectional view of the accelerating handle assembly of FIG. 1.

With reference to FIG. 5, a second clamping member 411 is mounted to an outer side of the first ring 1. The second clamping member 411 is arcuate and includes two ends that are diametrically opposed. Each end of the second clamping member 411 has a screw hole 413 threadedly receiving a fastener 412. The screw holes 413 of the second clamping member 411 are substantially parallel to each other. The second clamping member 411 is adapted to clamp on a handle body 6 of the electric vehicle. Damage to the handle body 6 can be avoided by operating the fasteners 412 extending through the diametrically opposed ends of the second clamping member 411.

Figure 3:
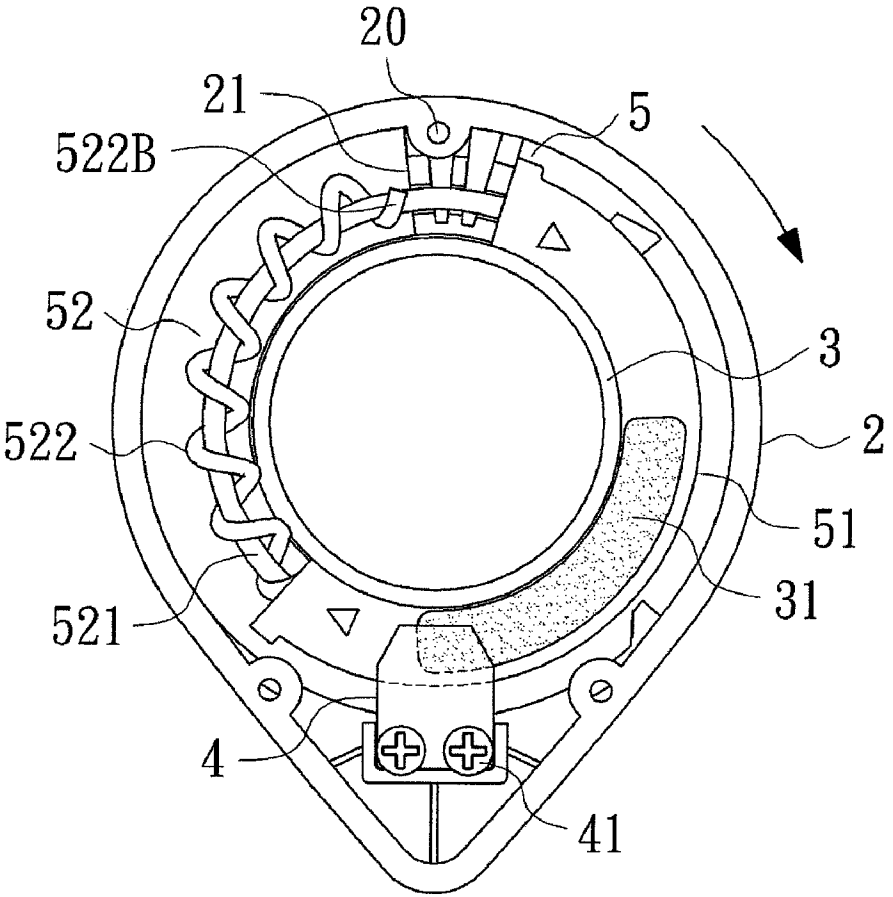
FIG. 3 shows a cross sectional view of the accelerating handle assembly of FIG. 1 with a tubular handle in an initial position.
Figure 4:
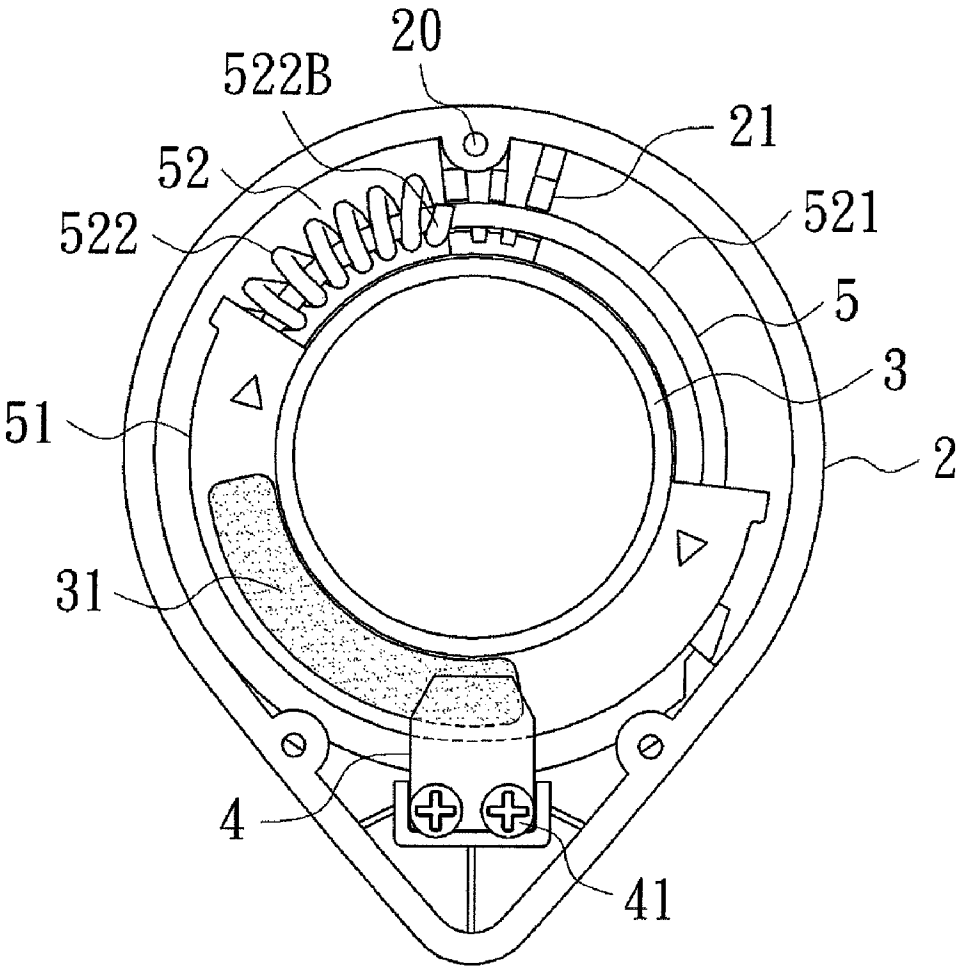
FIG. 4 shows a cross sectional view of the accelerating handle assembly of FIG. 1 with the tubular handle moved to its extreme position.

A driver of the electric vehicle can accelerate the electric vehicle by rotating the tubular handle 3 according to the preferred teachings of the present invention in a direction indicated by an arrow shown in FIG. 3. The tubular handle 3 can be rotated until it reaches an extreme accelerating position shown in FIG. 4. The first clamping member 51 is moved together with the tubular handle 3 and actuates the follower rod 521. Since the second end 522B of the compression spring 522 abuts the restraining block 21, the compression spring 522 is compressed to store elastic energy. When the drive releases the tubular handle 3 for decelerating purposes, the first end 522A of the compression spring 522 pushes the first clamping member 51 under the resilient returning action, moving the tubular handle 3 in the reverse direction and returning the tubular handle 3. By linear compressibility of the compression spring 522 according to the preferred teachings of the present invention, the tubular handle 3 can be returned from the accelerating position without the need of using a spring having a plurality of turns in the axial direction. A compact design is, thus, obtained.

Figure 2:
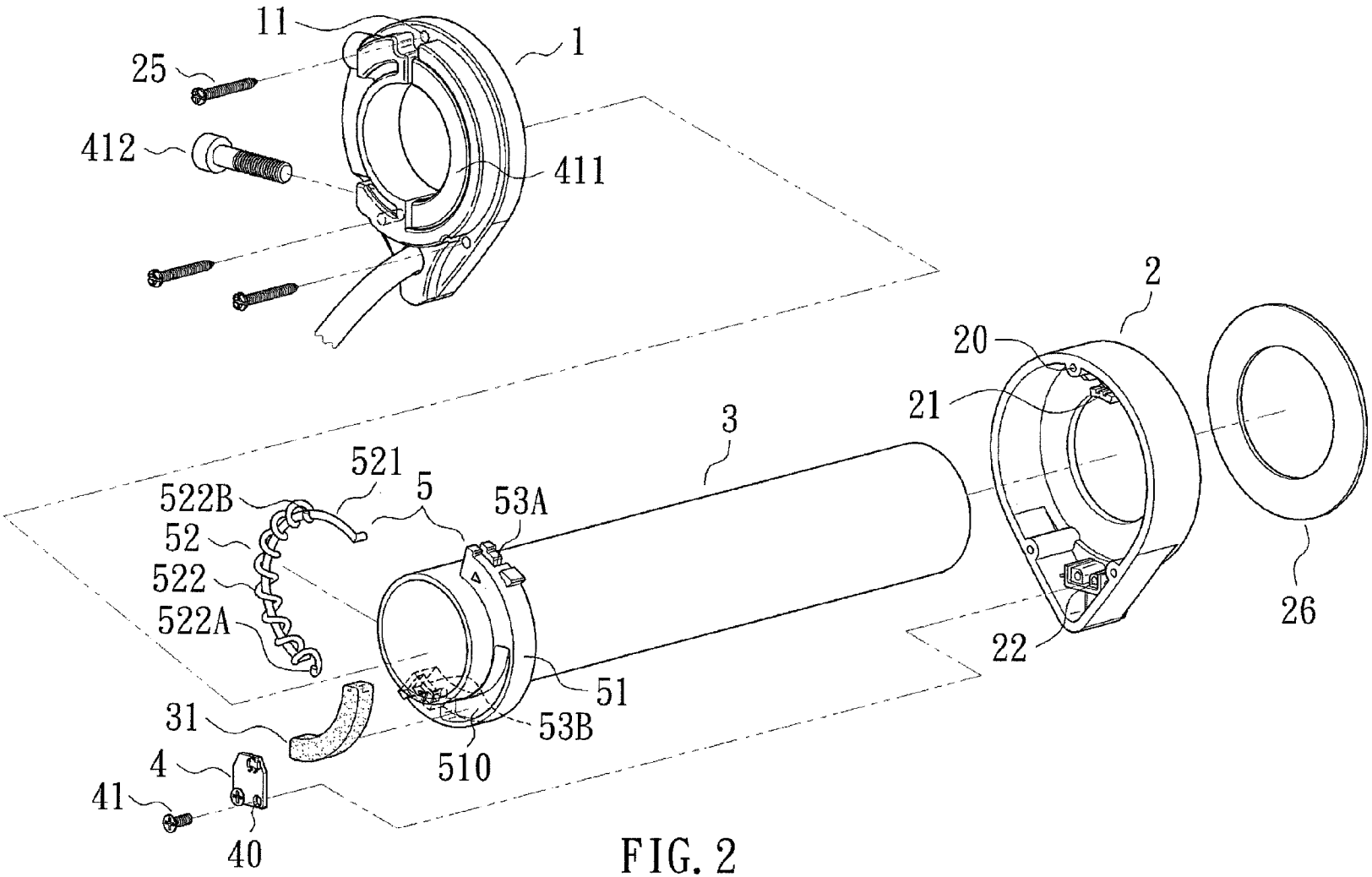
FIG. 2 shows an exploded, perspective view of the accelerating handle assembly of FIG. 1.

During rotation of the tubular handle 3, since the Hall sensor 4 is fixed to the second ring 2 and since the magnet 31 is fixed in the axial groove 510 (FIG. 2), the Hall sensor 4 detects a change in the magnetic poles of the magnet 31 and converts the change into signals indicative of acceleration or deceleration of the electric vehicle, which is conventional and, therefore, not described in detail to avoid redundancy.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An accelerating handle assembly for an electric vehicle comprising:

a first ring including an inner side having a stepped portion;

a second ring including a restraining block in a circumferential path defined by the second ring, with the first and second ring fixed together, with a gap formed between the first and second rings;

a tubular handle having an end received in the gap between the first and second rings and abutting the stepped portion of the first ring, with another end of the tubular handle located outside of the gap between the first and second rings, with a magnet mounted to the tubular handle;

a Hall sensor fixed to the first ring or the second ring, with the Hall sensor including a detecting face facing the magnet; and an elastic device including a first clamping member and a spring unit, with the first clamping member being arcuate and fixed to an outer periphery of the tubular handle, with the first clamping member including two ends respectively having two attachment seats, with the spring unit including a follower rod having two ends respectively fixed to the two attachment seats of the first clamping member, with the spring unit further including a compression spring having a first end abutting one of the two ends of the first clamping member, with the compression spring further having a second end abutting the restraining block of the second ring.

2. The accelerating handle assembly as claimed in claim 1, with the first clamping member including an axial groove, with the magnet received in the axial groove.

3. The accelerating handle assembly as claimed in claim 1, further comprising: a second clamping member mounted to an outer side of the first ring, with the second clamping member being arcuate and including two ends that are diametrically opposed, with each of the two ends of the second clamping member having a screw hole threadedly receiving a fastener, with the fasteners adapted to be operated to clamp the second clamping member on a handle body of the electric vehicle.

4. The accelerating handle assembly as claimed in claim 1, with the second ring including an annular body having a top section with a bottom edge, with the restraining block formed on the bottom edge of the top section of the annular body of the second ring.

* * * * *